United States Patent [19]

McDonough

[11] Patent Number: 4,965,892

[45] Date of Patent: Oct. 30, 1990

[54] SYPHONIC FLUSH TOILET

[76] Inventor: James B. McDonough, 3306 San Carlos Dr., Spring Valley, Calif. 92077

[21] Appl. No.: 343,615

[22] Filed: Apr. 27, 1989

[51] Int. Cl.[5] ..... E03D 1/06

[52] U.S. Cl. ..... 4/368; 4/369; 4/375; 4/377

[58] Field of Search ..... 4/373, 375, 368, 372, 4/374, 369–371, 377, 421–422, 425–426

[56] References Cited

U.S. PATENT DOCUMENTS

| | | | |
|---|---|---|---|
| 222,885 | 12/1879 | Field | 4/368 X |
| 440,197 | 11/1890 | Putnam | 4/368 X |
| 815,661 | 3/1906 | Vissing, Jr. | 4/372 |
| 1,077,329 | 11/1913 | Cabral | 4/375 |
| 1,137,578 | 4/1915 | Coburn | 4/368 |
| 1,822,060 | 9/1931 | Powell | 4/373 |
| 2,580,898 | 1/1952 | Alzucyarray | 4/375 X |
| 3,094,706 | 6/1963 | Pihl et al. | 4/372 |
| 3,561,013 | 2/1971 | Lopez | 4/372 |

FOREIGN PATENT DOCUMENTS

| | | | |
|---|---|---|---|
| 6165 | 2/1932 | Australia | 4/368 |
| 524479 | 3/1956 | Belgium | 4/375 |
| 910040 | 4/1954 | Fed. Rep. of Germany | 4/368 |
| 1020936 | 12/1957 | Fed. Rep. of Germany | 4/368 |
| 1023421 | 1/1958 | Fed. Rep. of Germany | 4/374 |
| 1169478 | 12/1958 | France | 4/375 |
| 19014 | 10/1891 | United Kingdom | 4/368 |
| 22028 | 12/1898 | United Kingdom | 4/375 |
| 15192 | 4/1905 | United Kingdom | 4/368 |
| 994538 | 6/1965 | United Kingdom | 4/368 |

*Primary Examiner*—Henry K. Artis

*Attorney, Agent, or Firm*—Charles C. Logan, II

[57] ABSTRACT

A syphonic flush toilet having a conventional water tank having a drain outlet in its bottom wall. The tank has a lid having a plunger aperture therein. A syphon assembly formed of a floating top housing member and a stationary bottom housing member are located in the tank. The floating top housing member has a top wall having a downwardly extending annular outer side wall and the bottom housing member has a bottom wall having an upwardly extending annular outside wall. The annular outer side wall and the annular outside wall of the respective members are matingly telescopically connected to each other about a vertical axis. An air chamber is formed in the floating top housing member. A discharge pipe has its bottom end passing through the bottom wall of the bottom housing member and its lower end is secured in the drain outlet of the tank. The top end of the discharge pipe extends upwardly into the interior of the neck portion of the floating top housing member. The plunger assembly passes through the plunger aperture in the lid and it has its bottom end connected to the top of the neck portion of the floating top housing member. When the plunger assembly is pushed downwardly, water in the interior of the syphon assembly is pushed upwardly over the top edge of the discharge pipe to produce a syphon effect that causes the remaining water in the syphon assembly to be drawn downwardly through the discharge pipe. Inlet ports in the bottom wall of the bottom housing member have valves that open during the flushing operation to allow a new charge of water to be drawn upwardly through the inlet ports into the syphon assembly. The toilet bowl has a pair of half traps formed in its serpentine configured water discharge passage ways that aid in the syphonic flush operation of the toilet.

12 Claims, 1 Drawing Sheet

SYPHONIC FLUSH TOILET

BACKGROUND OF THE INVENTION

The invention relates to toilets and more specifically to syphonic flushing apparatus located in the water tank of a toilet.

In the past, it has often been the custom to use a drop valve for closing the outlet pipe of a toilet tank but such valves are subject to leakage when they wear, with subsequent wastage of water which can represent a severe economic drain on the community. Syphonic flushing devices have been proposed which eliminate the risk of wastage of water in this way because the loop of the syphon is normally located above the water level of the tank, thus breaking the path for water to flow out of the tank until syphonic action is started. However, good syphonic action is dependent upon there being no air leakage into the syphon which would stop syphonic flow. Previously proposed syphonic flushing apparatus has been subject to air leakage into the syphon past the moving parts of the apparatus.

It is an object of the invention to provide a novel syphonic flush toilet that reduces the risk of air leakage through the walls of the syphon assembly.

It is another object of the invention to provide a novel syphonic flush toilet that utilizes a two piece plastic syphon assembly.

It is a further object of the the invention to provide a novel syphon assembly that is economical to manufacture and market.

It is an additional object of the invention to provide a novel syphon assembly that can be retrofit into existing toilet water tanks.

SUMMARY OF THE INVENTION

The operation of applicant's novel syphonic flush toilet will now be described. The syphon assembly located in the interior of the tank is formed of a floating top housing member and a stationary bottom housing member. The floating top housing member has a top wall having a downwardly extending annular outer side wall having a predetermined width. The bottom housing member has a bottom wall having an upwardly extending annular outside wall having a predetermined width. The annular outer side wall and the annular outside wall are matingly telescopically connected to each other about a vertical axiss. An air chamber within the floating top housing member makes it bouyant.

An elongated vertically oriented discharge pipe has its bottom end secured in the drain outlet of the tank. The discharge pipe extends upwardly through the interior of the bottom housing member and the floating top housing member. The discharge pipe may be formed integrally of plastic with the bottom housing member.

The floating top housing member has an upwardly extending neck portion whose top end is closed by a plunger assembly that passes through an aperture in the lid of the tank. A plurality of inlet ports are formed in the bottom wall of the bottom housing member and they are covered by a disc-shaped cover plate that functions as a valve.

The flushing operation commences by pressing the plunger assembly downwardly. It in turn forces the floating top housing member downwardly causing water within its interior to be forced upwardly over the top edge of the discharge pipe thereby producing a syphonic flow. A predetermined amount of water in the order of 1 to 1½ gallons is thus emptied into the discharge pipe. While this is occuring, the disc-shaped cover plate is lifted upwardly by water entering the inlet ports in the bottom wall of the bottom housing member thus recharging the syphon assembly. Stop members on the outer surface of the discharge pipe limit the vertical travel of the disc-shaped cover plate. The incoming water into the interior of the water tank causes the floating top housing member to float upwardly. Its upper travel is limited by stop members extending inwardly from its neck portion that contact the top wall of the discharge pipe. A conventional ballcock would be installed in the interior of the water tank for filling the interior thereof.

The water which has been drawn out of the syphon assembly by the above described syphonic action travels downwardly through the discharge pipe into the toilet bowl. This toilet bowl has an upper serpentine discharge passage having a half trap formed therein. The cross sectional area of the discharge passage has not been restricted so that a full flow of water may pass there through, however the half trap configuration provides a water pocket that restricts the cross section of the discharge passage thus preventing air traveling upwardly therethrough to interrupt or break the syphon flow. Formed in the lower part of the toilet bowl is a lower serpentine discharge passage for the waste products deposited into the toilet bowl. This discharge passage also has a half trap whose cross sectional opening space has not been reduced thereby allowing the waste products to pass cleanly therethrough. The lower dip portion of a half trap however will fill with clean water at the end of the flush and it also functions to prevent air from traveling upwardly through the lower serpentine discharge passage and keeping it from interrupting the syphon flow that has been formed.

DESCRIPTION OF THE PREFERRED EMBODIMENT

Figure 1:
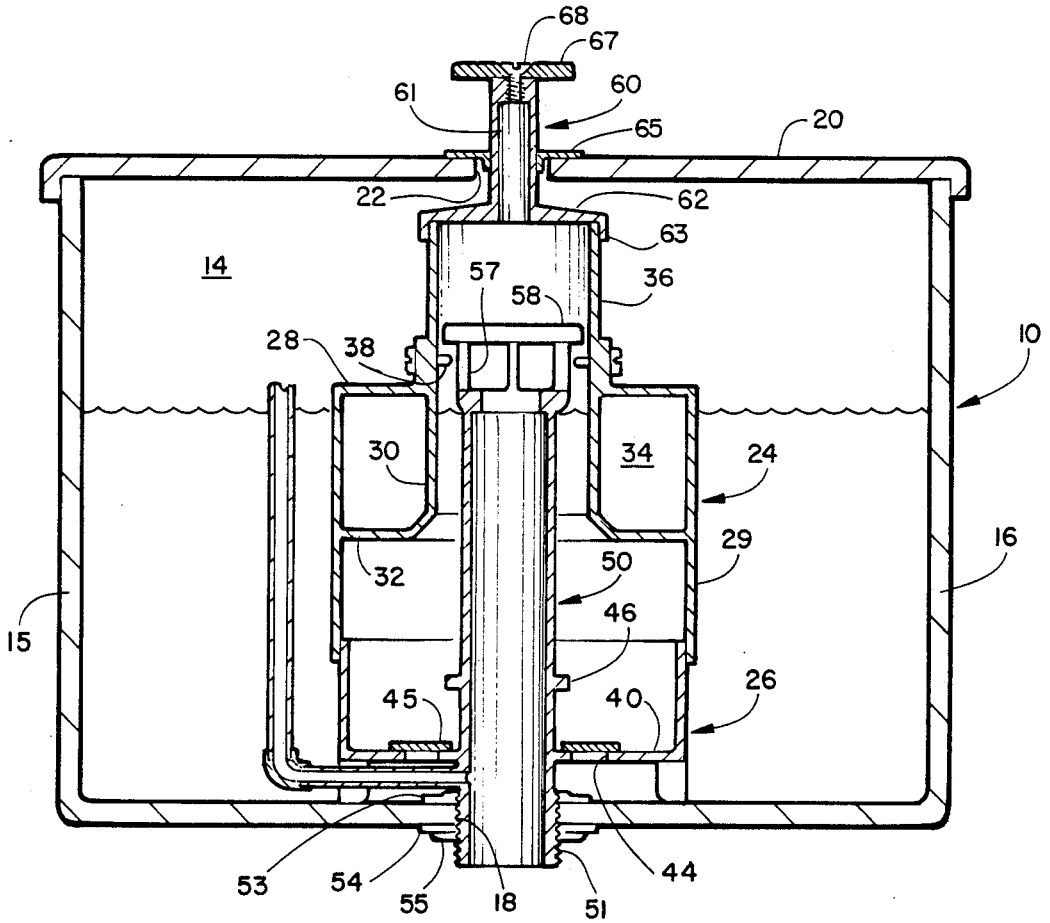
FIG. 1 is a front cross sectional elevation view of the tank of the toilet.

Applicant's novel syphonic flush toilet will now be described by referring to FIGS. 1–2 of the drawing. The water tank is generally designated numeral 10 and the toilet bowl is designated numeral 12.

Water tank 10 has a rear wall 14, side walls 15 and 16 and a bottom wall 17. A drain outlet 18 is formed in bottom wall 17. A lid 22 covers the open top end of tank 10 and it has a plunger aperture 22 therein. The syphon assembly is formed from floating top housing member 24 and stationary bottom housing member 26. Floating top housing member 24 has a top wall 28 having downwardly extending side walls 29. An inner tubular wall 30 and disc-shaped intermediate wall 32 form an air chamber 34. A neck portion 36 extends upwardly from top wall 28. A plurality of stop members 38 extend inwardly from neck portion 36.

Stationary bottom housing member 26 has a bottom wall 40 having upwardly extending side walls 42 that matingly telescopically connect with outer side walls 29. A plurality of inlet ports 44 are formed in bottom wall 40 and a disc-shaped cover plate 45 functions as a valve for these inlet ports. A stop member 46 limits the upward travel of disc-shaped cover plate 45 when a refill charge of water enters the syphon assembly.

Discharge pipe 50 has external threads 51 formed on its lower end. A rubber gasket 53, a sealing ring 54 and a nut 55 provide a water tight seal for rigidly holding the bottom end of discharge pipe 50 in drain outlet 18. The top end of discharge pipe 50 has a plurality of inlet ports 57 and a top wall 58. The outer edges of top wall 58 engage stop members 38 to limit the upward travel of floating top housing member 24.

Plunger assembly 60 has a post 61 that passes downwardly through plunger aperture 22. Its bottom end has a cap member 62 formed thereon with a downwardly extending annular flange 63. Cap member 62 closes the top end of neck portion 36. A cover disc 65 covers the top surface of plunger aperture 22. A push cover 67 is secured by a screw 68 to the top end of post 61.

Figure 2:
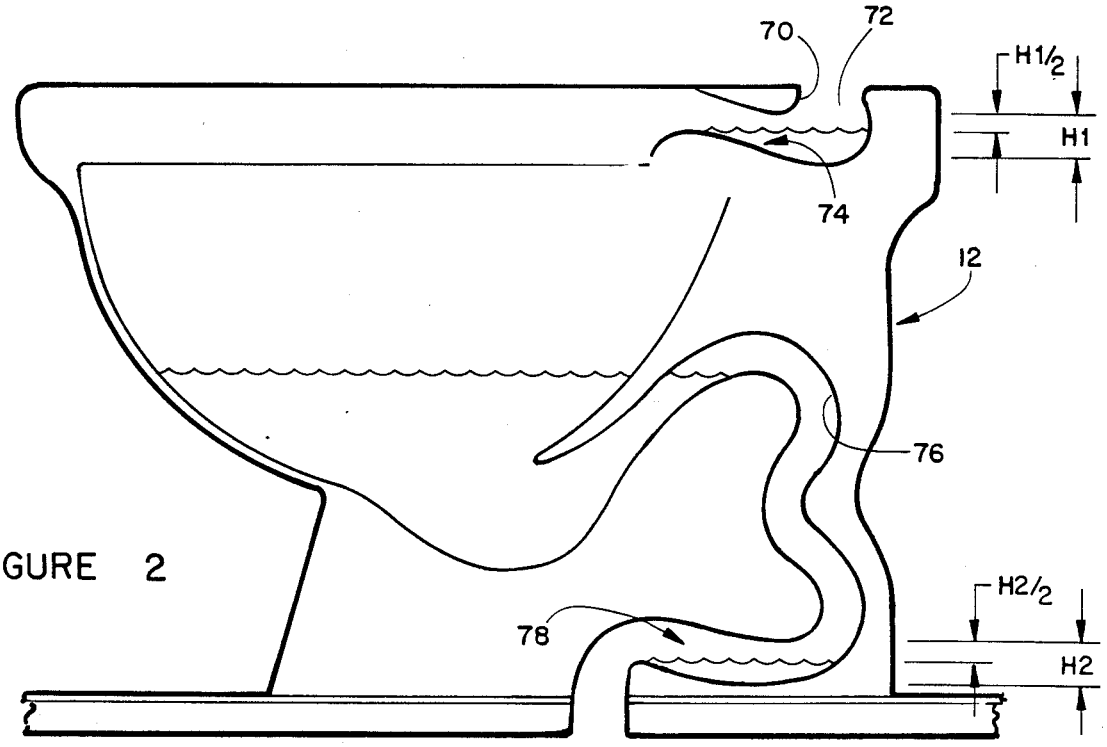
FIG. 2 is a schematic cross sectional view of the interior water passages of the toilet bowl.

Toilet bowl 12 is schematically illustrated in FIG. 2. It has a aperture 70 formed at its top end into which the bottom end of discharge pipe 50 would be inserted. The upper serpentine discharge passage 72 has a half trap 74 formed therein. A normal opening height of the discharge passage is H1 but the half trap structure reduces the size of the opening to ½ H1. This structure aids in preventing air from traveling upwardly through the upper serpentine discharge passage 72 to break the syphon flow formed from water traveling downwardly through discharge pipe 50. A lower serpentine discharge passage 76 is formed in the lower portion of toilet bowl 12. It has a half trap 78 formed therein. Half trap 78 has a normal opening height of H2, but the trap configuration narrows the opening to ½ H2 and thereby aids in preventing the breaking of the syphon flow action of the waste water that is traveling downwardly through lower serpentine discharge passage 76. The half traps 74 and 78 allow a full size opening for passage of water and waste products therethrough while still aiding and preventing the breaking of the syphon flow therethrough.

What is claimed is:

1. A syphonic flush toilet comprising:

a tank having a front wall, a rear wall, a pair of laterally spaced side walls, and a bottom wall that forms an open top water chamber, a lid for said tank having a plunger aperture therein, a drain outlet formed in said bottom wall;

a syphon assembly formed of a floating top housing member and a bottom housing member, said floating top housing member having a top wall having a downwardly extending annular outer side wall having a predetermined width, said bottom housing member having a bottom wall having an upwardly extending annular outside wall having a predetermined width, said annular outer side wall and said annular outside wall being matingly telescopically connected to each other about a vertical axis;

means for making said floating top housing bouyant;

an elongated vertically oriented discharge pipe having a top end and a bottom end, said bottom end passing through the drain outlet of said tank, said discharge tube extending upwardly within the interior of said floating top housing member and said bottom housing member;

locking means for securing the bottom end of said discharge pipe in said drain outlet with a water tight seal;

means for flushing said toilet comprising a plunger assembly having a top end that extends upwardly through the plunger aperture in said lid, the bottom end of said plunger assembly is connected to said floating housing member whereby downward pressure on said plunger assembly will force said floating top member downwardly to force water within said syphon assembly upwardly until it flows into the top end of said discharge tube to create a syphon that will extract a predetermined volume of water from the tank; and the above structure being in combination with a toilet bowl having an upper serpentine discharge passage molded herein and configured to form a first half trap for preventing air from breaking the syphon from the water tank during the flushing operation.

2. A syphonic flush toilet as recited in claim 1 further comprising at least one inlet port in said bottom housing member.

3. A syphonic flush toilet as recited in claim 2 further comprising valve means for opening and closing said inlet ports.

4. A syphonic flush toilet as recited in claim 1 wherein said means for making said floating top housing bouyant comprises an air chamber formed therein.

5. A syphonic flush toilet as recited in claim 3 wherein said valve means is an annular shaped disc cover plate.

6. A syphonic flush toilet as recited in claim 5 further comprising means for limiting the height that said annular shaped disc plate can be opened.

7. A syphonic flush toilet as recited in claim 1 wherein said floating top housing member has a neck portion extending upwardly from its top wall and the top end of said discharge tube extends upwardly into said neck portion.

8. A syphonic flush toilet as recited in claim 7 further comprising means for limiting the height to which said floating top housing member can rise in the water.

9. A syphonic flush toilet as recited in claim 1 wherein said discharge pipe is formed integrally with said bottom housing member.

10. A syphonic flush toilet as recited in claim 9 wherein said bottom housing member and said floating top housing member are both made of plastic material.

11. A syphonic flush toilet as recited in claim 1 wherein said bottom housing member and said floating housing have a cylindrical configuration.

12. A syphonic flush toilet as recited in claim 1 further comprising a lower serpentine discharge passage in said toilet bowl configured to form a second half trap for preventing air from breaking the syphon from the toilet bowl during the flushing operation.

* * * * *